US005452940A

United States Patent [19]

Maier

[11] Patent Number: 5,452,940

[45] Date of Patent: Sep. 26, 1995

[54] PRESSURE RELIEF BACK CUSHION

[76] Inventor: Edmund K. Maier, 76 Woodside Dr., Penfield, N.Y. 14526

[21] Appl. No.: 102,148

[22] Filed: Aug. 4, 1993

[51] Int. Cl.[6] ..... A47C 7/02

[52] U.S. Cl. ..... 297/452.32; 297/452.27; 297/252.35; 297/452.37; 297/DIG. 1

[58] Field of Search ..... 297/219.1, 230.1, 297/230.12, 230.11, 284.4, 284.5, 452.22, 452.27, 452.3, 452.31, 452.32, 452.33, 452.35, 452.37, DIG. 1

[56] References Cited

U.S. PATENT DOCUMENTS

| | | | |
|---|---|---|---|
| 2,855,986 | 10/1958 | Engelen | 297/230.1 X |
| 3,749,442 | 7/1973 | Berg et al. | 297/452.31 X |
| 4,189,182 | 2/1980 | Rhoe | 297/452.32 |
| 4,951,334 | 8/1990 | Maier | 297/DIG. 1 X |
| 5,039,158 | 8/1991 | Maier | 297/452.37 |

FOREIGN PATENT DOCUMENTS

| | | | |
|---|---|---|---|
| 1202351 | 8/1970 | United Kingdom | 297/452.35 |
| 2130086 | 5/1984 | United Kingdom | 297/452.35 |
| 8607528 | 12/1986 | WIPO | 297/452.27 |

*Primary Examiner*—Laurie K. Cranmer

[57] ABSTRACT

An integral lower back pressure relief cushion with a substantially U-shaped aperture at the lower portion of the cushion open at the bottom and extending from the front to the rear of the cushion, such that the sacral and coccyx areas of the user are free from pressure contact while the portions of the cushion on either side of the aperture support the posterior superior iliac spine of the user, the cushion comprising at least three segments of resilient material, a removable convex shape in the front side above the aperture, and the rear side having a convex side and support base.

16 Claims, 4 Drawing Sheets

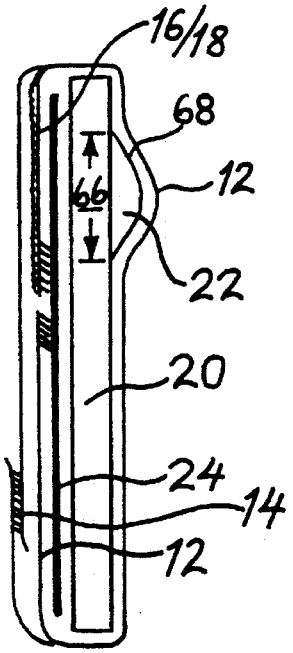
FIG 4
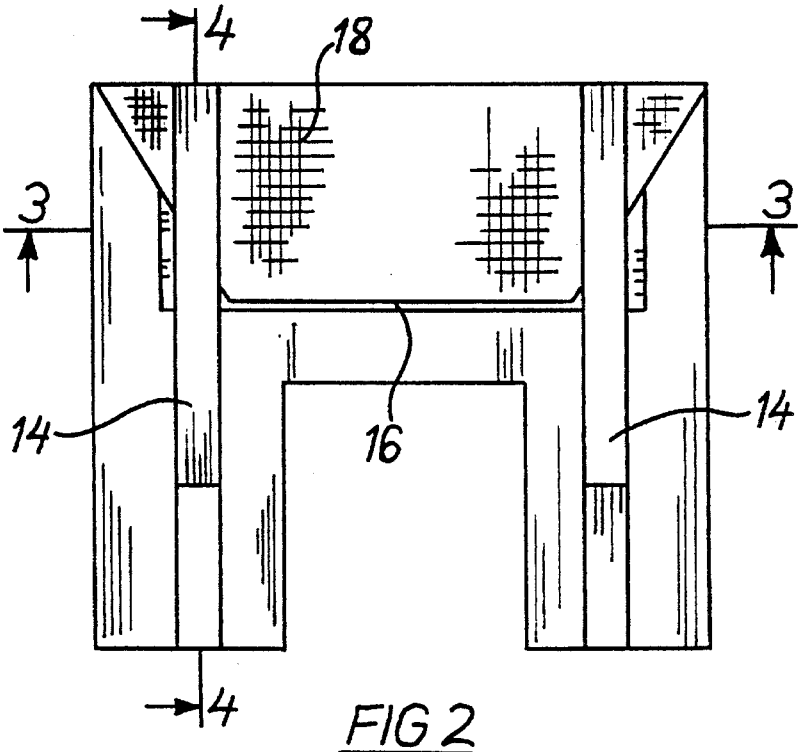
FIG 2
FIG 3
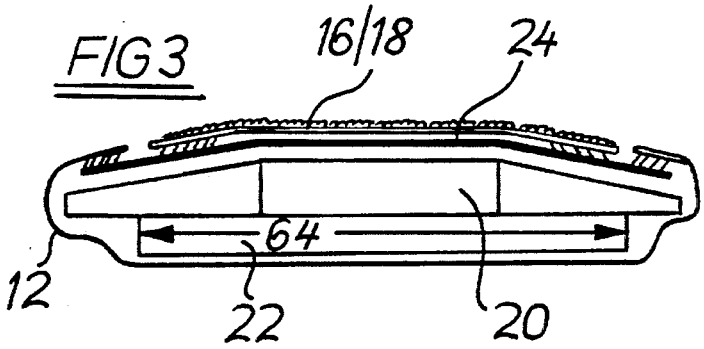
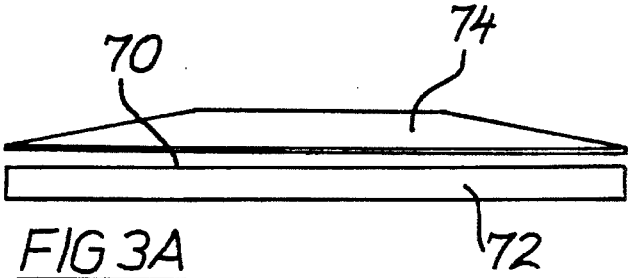
FIG 3A

PRESSURE RELIEF BACK CUSHION

FIELD OF THE INVENTION

This invention relates to seating cushions for adjusting and/or eliminating pressure concentrations on portions of the human body while also supporting portions of the human body, in this case the middle and lower back.

BACKGROUND OF THE PRIOR ART

Patients who are forced to sit relatively immobile for long periods of time often experience decubitus ulcers (also known as pressure or bed sores) of the skin due to the concentrated pressures upon the patients' ischium, sacrum and coccyx areas. The latter two occur as a function of unsupported rearward tilt of the pelvis about the ischium causing slouching and thereby contact of the sacrum and coccyx with the seat and backrest. Once a sore occurs, the patient historically has not been able to resume sitting until the sore heals. Physical contact of any kind with the affected area results in pressure, heat, and humidity buildup which will result in further injury to the site, infection, and oftentimes death from ensuing infection.

Along with pressure, this tilting of the pelvis also changes the lumbo-sacral curve of the lower back such that lower back pain and poor posture often results. Devices designed to support the lower back often degrade the seating environment. They reduce lower limb support by reducing the effective depth of the seat bottom and either force the body to sit in positions which are unnatural or do not give adequate cushioning and support for proper posture and comfort.

U.S. Pat. No. 4,688,285 of Robert discloses a medical cushion for minimizing pressure areas on portions of human anatomy. However, the cushion of this patent does not control the tilt of the pelvis due to the location of its aperture, and is not designed to support the lower back.

U.S. Pat. No. 4,122,567 of Hanson discloses an articulated bed having a U-shaped cavity at one of its ends. There is no disclosure in Hanson of means for eliminating pressure while seated, and in so doing also controlling the tilt of the Pelvis thereby removing contact pressure on Sacrum and Coccyx.

U.S. Pat. No. 3,856,349 of Light discloses (at column 1) that ". . . during prolonged sitting the lower back, at rest, gradually assumes the curvature of the material it is resting against, and, if this is a cushion or a curved seat back, the person's natural lordosis is accentuated." However, the device of this patent does not provide adequate cushioning to the lower back and, furthermore, artificially constrains the back into an unnatural and uncomfortable position. It particularly does not eliminate contact pressure to the sacrum and coccyx.

U.S. Pat. No. 4,471,993 of Watson describes a device for supporting the lower back area of the body comprising a front resilient member and an inner core. However, because of the dimensions and configuration of the device of this patent, one using it is pushed forward in the seat and thus cannot utilize all of the support afforded by the entire length of the seat bottom.

U.S. Pat. No. 5,039,158 of Maier, describes a multi-segmented lumbo-sacral support which provides support to the curvature of the lower back while simultaneously alleviating local pressure on the bony protuberances of the spinal column. However, the device does not suspend the sacral area such that it remains contact free, and its support is limited to the lumbo-sacral curve of the lower back, and can be used only by patients with relatively unimpeded range of motion in their hips.

U.S. Pat. No. 4,951,334 of Maier, describes a pressure relief cushion designed to eliminate pressure on the Ischium and control pelvic tilt to minimize and often eliminate sacrum and coccyx pressure. The design by itself does not ensure that the sacrum and coccyx areas would remain contact free for all patients, particularly those with limited hip rotation, and provides no means for direct support of the lower back.

SUMMARY OF THE INVENTION

In accordance with this invention, there is provided a pressure relief back support cushion which is constructed of: an integral core consisting of one to three segments of resilient material, at least one of which is shaped to provide the device a convex shape and at least one of which provides a pressure eliminating aperture for the sacrum and coccyx; a moveable and removable lumbo-sacral support element, a cover containing attachment and anti-slip provisions which also allow for insertion of specialty positioning elements.

With this invention, there is also provided a combination back/seat cushion that provides a combination pressure elimination aperture at the most pressure sensitive body areas of the ischium, sacrum and coccyx while also providing positive body support, body restraint and posture control during patient seating for extended time periods.

It is an object of this invention to provide a pressure relief back support cushion which, when in place on the back of a seating surface or device, provides support to the middle and lower back while simultaneously eliminating pressure for contact free suspension of the sacrum and coccyx regions of the body.

It is another object of this invention to provide a pressure relief back cushion whose integral core provides an aperture shaped in cross section and periphery to simultaneously provide both pressure elimination to the sacrum and coccyx areas of the body and progressively increasing resistance to the reward penetration of the lower back area of the human body to provide improved physical suspension of the sacrum and coccyx body area and to provide air circulation as well as reduced heat and humidity build-up to sacrum and coccyx body areas.

It is another object of this invention to provide a pressure relief back support cushion with arcuate rear curvature so adapted as to allow the patient to substantially utilize all of the support afforded by the length of the seat bottom and utilize this invention on a variety of existing wheelchair and other seating devices.

It is another object of this invention to provide a pressure relief back cushion which is self supporting and resists shifting and unplanned dislocation through the use of a rigid support base insert, anti-slip mat equipped cover, and auxiliary attachment straps.

It is another object of this invention to provide a pressure relief back cushion with an additional, moveable and removable lumbo-sacral support element, to provide added lower back support for various body shapes and sizes.

It is another object of this invention to provide a combination back and seat pressure elimination cushion that extends the pressure elimination aperture of the cushion both forward of the ischials and up the seat back to provide broader contact pressure elimination at the most critical back and seat pressure sensitive areas in a wider population of patients.

It is another object of this invention to provide a pressure relief back cushion that is so shaped and constructed that it can be used on a variety of wheelchairs and other seating.

It is another object of this invention to provide a pressure relief back cushion that with a stretchable cover may be used in conjunction with positioning elements and the lumbo-sacral support element to provide more specialized body support for the severely disabled.

DESCRIPTION OF THE DRAWINGS

The present invention will be more fully understood by reference to the following detailed description thereof, when read in conjunction with the attached drawings, wherein like reference numerals refer to like elements and wherein:

FIG 2 is a rear view of the preferred embodiment of FIG. 1;

FIG. 3 is a top sectional view of the preferred embodiment taken on a line as shown in FIG. 2;

FIG. 3A is a top sectional view of an alternate embodiment taken on line 3 of FIG. 2;

FIG. 4 is a side sectional view taken on line 4 as shown in FIG. 2;

DESCRIPTION OF THE PREFERRED EMBODIMENTS

Figure 1:
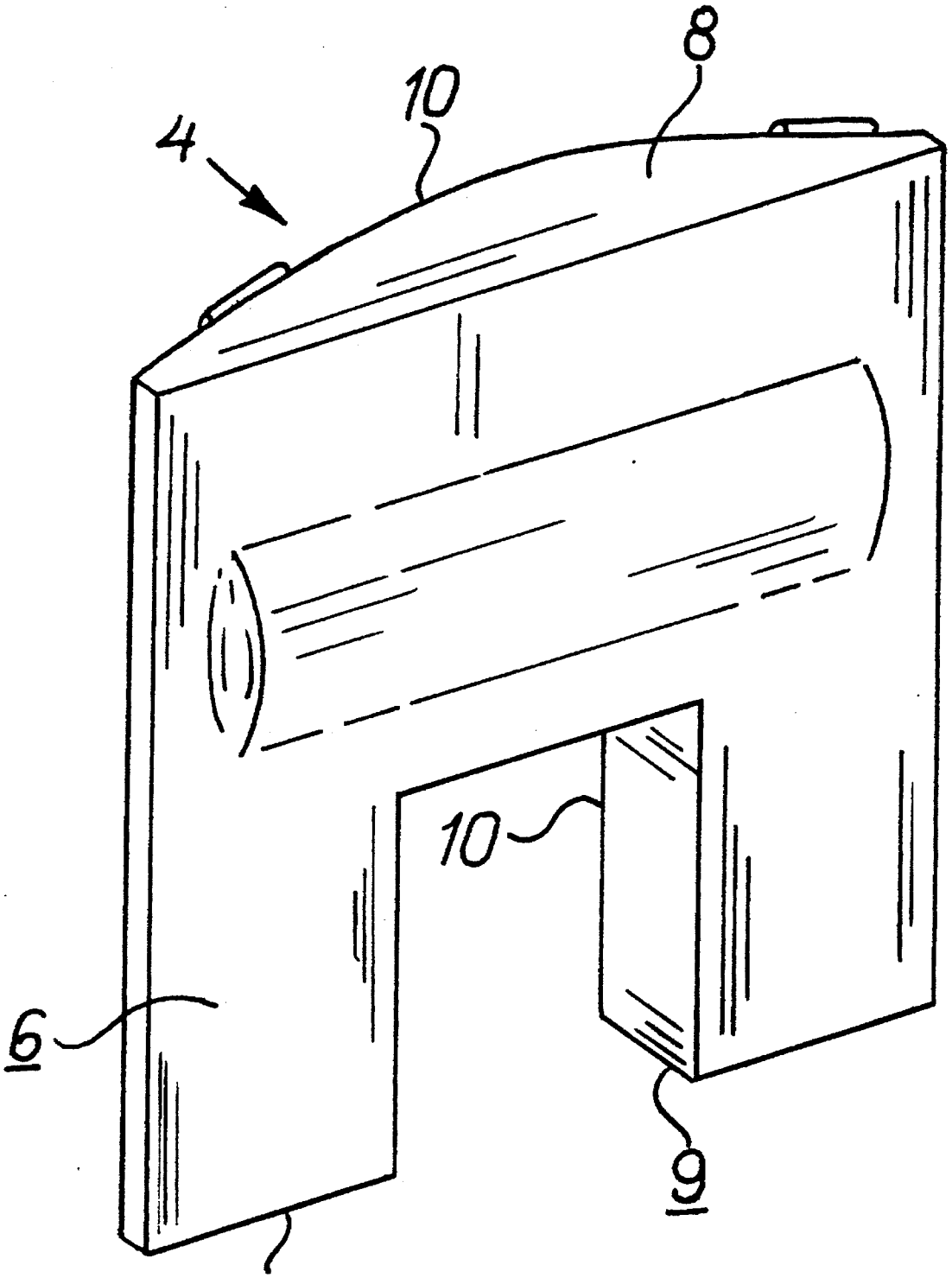
FIG. 1 is a perspective view of one preferred embodiment of this invention.

Referring to FIG. 1, which is a front perspective view of a preferred embodiment of the invention, the pressure relief back cushion 4 is substantially rectilinear and an inverted "U" in overall shape and comprises a front side 6, a top side 8, a bottom side 9 and rear side 10.

The rear, top sectional and side sectional views FIGS. 2, 3, and 4 of cushion 4 show a sewn outer cover 12 preferably of a durable moisture resistant woven material such as Cordura brand nylon enclosing all outer surfaces of the cushion and containing a closure flap 16 at upper rear of the cover 12 which is used both for assembly and for adjustment/modification of the cushion as will be described. The cover closure flap 16 is as shown in FIG. 2, and on preferably the entire outer back surface of the flap 16 is an anti-slip material 18 such as PVC coated or rubberized fabric webbing.

Straps 14 attached to the top and bottom sides of the cover 12 as shown enable the cushion 4 to be positioned appropriately on a wheelchair or other seating device. The straps are made in two opposing sections each of mating hook/loop fastener material such as Velcro brand material with the hook strap of elastic material to enable a firm yet adjustable attachment of the cushion 4 to the seating device. Velcro brand strips or the like are attached at appropriate points to the inner surface of the flap 16 and the inner back surfaces of both the main cover portion. Mating strips are attached to the support base 24 described later to permit the flap to be opened and to retain the flap closed and to attach the cover surrounding the core to the cushion during normal use.

Figure 5:
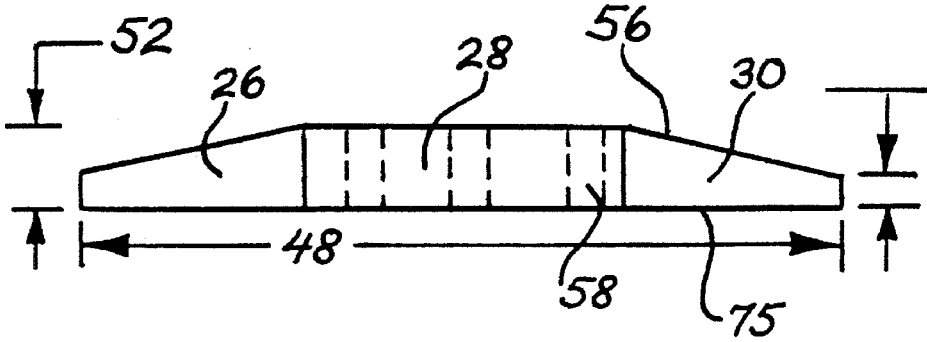
FIGS. 5 & 6 are top and front views respectively of a preferred embodiment of the integral resilient core.
Figure 6:
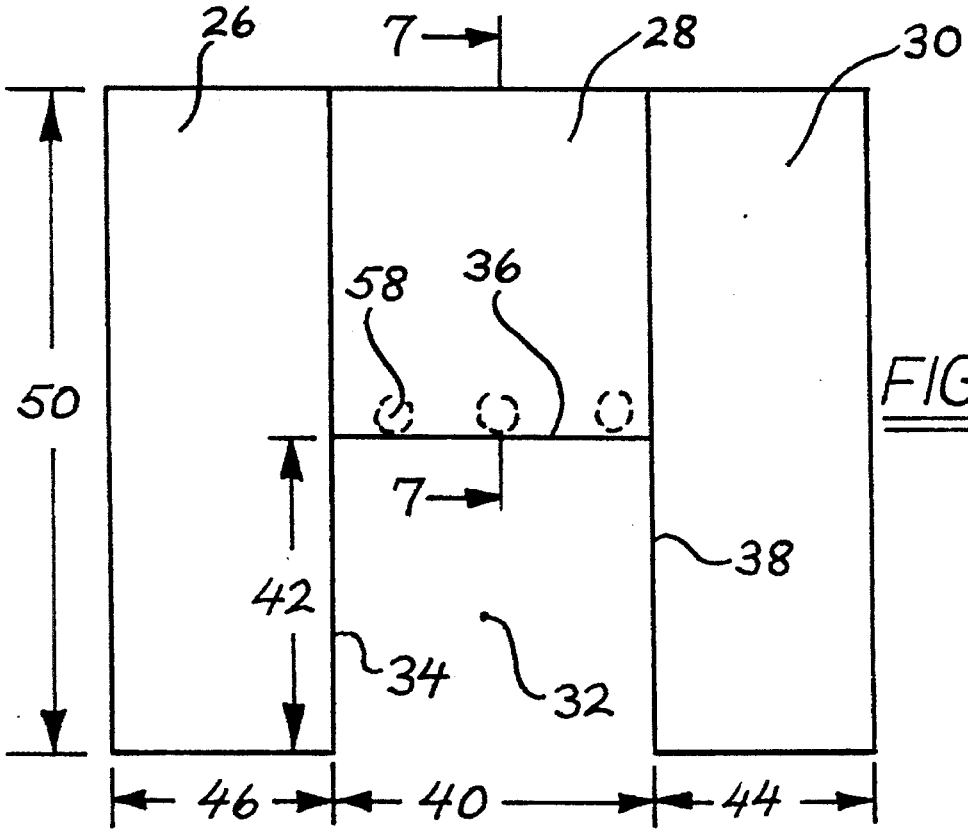
Figure 7:
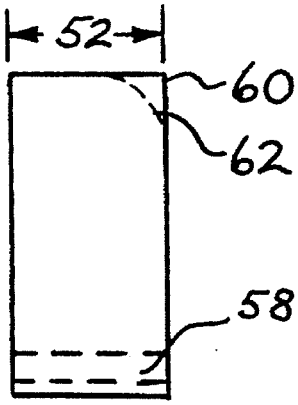
FIG. 7 is a side sectional view taken on a line in FIG. 6 and illustrating two preferred features of the integral resilient core; and FIGS. *7a* and *7b* illustrate a further alternate aspect of the invention, with FIG. *7a* a partial view thereof and FIG. *7b* a partial cross section taken on a line in FIG. *7a;*

Inside the cover 12 is an integral support core 20 that provides the principal pressure relief/support feature of the invention as will be described; a moveable and removable lumbo-sacral support element 22, and a thin but rigid support base 24 behind core 20 and having horizontal and vertical dimensions approximately the same as but slightly smaller than the corresponding dimensions of the core 20. FIG. 5, FIG. 6, and FIG. 7 are a top view, a front view and a side sectional view of the integral support core of the embodiment of FIG. 1.

The integral support core 20 as shown in FIGS. 5, 6 and 7 is preferably comprised of at least 3 segments 26, 28, and 30 which are comprised of foam material. The term "foam" as used in this specification refers to a material with a sponge like, cellular structure and includes materials such as polyurethane foam, foam rubber, flexible foamed thermoplastic elastomers, and the like, including the foam materials described in my U.S. Pat. Nos. 4,951,334 and 5,039,158, the disclosures of which are hereby incorporated by reference into this specification.

Each of segments 26, 28, and 30 comprising the core 20 consists essentially of soft elastic material. One such material is foam such as polyurethane foam, which may be as described in my two identified patents, or one may use polyurethane foams obtainable from other sources such as VITA FOAM Ltd, Toronto, Ontario, Canada, or from North Carolina Foam Industries, Mount Airy, N.C.

The foam for segments 26, 28, and 30 have a density of at least 1 pound per cubic foot (PCF) and an Indention Load Deflection (ILD) stiffness of at least about 25 pounds, but no more than an ILD of 125 pounds. These physical properties of the foam may be determined in accordance with A.S.T.M. Standard Test D-3574-81, the disclosure of which is hereby incorporated by reference into this specification.

Integral support core 20 may be fabricated by means well known to those skilled in the art and as described in referenced patents. In the preferred embodiment, support core 20 is fabricated from discrete segments 26, 28, and 30. In another embodiment, the support core 20 is produced by a molding process known in the foam products industry.

In one preferred form, segments 26, 28, and 30 all consist of the same material with the properties described above. In an alternate form, segments 26 and 30 have the same stiffness while segment 28 consists of a softer foam material that is about thirty percent softer than segments 26 and 30. In still another form, support core 20 consists of the softer prefabricated segment 28 about which segments 26 and 30 are molded in situ by injecting foam producing reactants for each segment in the mold in a specific sequence as is known in the foam producing art.

Support core segments 26, 28, and 30 must have specified dimensions in order for support core 20 to have the desired properties. These specified dimensions comprise a range that is appropriate to a variety of patient sizes from small pediatric patients to large adult patients whereby the sacral and coccygeal areas of the body are suspended in the center of the aperture 32 without touching the cushion 4, while the upper rear portion of the pelvic girdle is prevented from rotating rearward by support contact with the front sides of the leg extensions formed by the bottom portions of segments 36 and 30 of support core 20 within cushion 4.

Thus referring to FIG. 6, aperture 32 is substantially rectilinear in shape and is formed by the inner sides 34, 36, and 38 of segments 26, 28, and 30, and in the preferred embodiment, aperture 32 has a width 40 of no less than about 3.0 inches and no more than about 10.0 inches depending on patient size, and a height 42 which is to be at least 4.0 inches but no larger than 10.0 inches also depending on patient size. Support core 20 segments 26 and 30 preferably have a width 44 of at least 2.0 inches which also equals width 46, an overall width 48 of at least 7.0 inches to about 30 inches depending on patient and chair size, and an overall height 50 of at least 8 inches up to about 36 inches depending on patient torso length and back support requirements. Referring to FIG. 5, in the preferred embodiment, support core 20 has a minimum thickness 52 of no less than 1.5 inches and tapers from a maximum width in the center toward the front surface to a minimum width 54 of 0.0 inches to form a rear convex surface. In the preferred embodiment, segment 28 is of uniform thickness and segments 26 and 30 taper from the maximum thickness 52 to a minimum thickness 54. In another embodiment, rear side 56 of support core 20 is a continuous curve comprising the rear sides of segment 26, 28, and 30. The variety of embodiments for the convex rear surface is required to accommodate the variety of chair back and wheelchair sling geometries available to the patient.

Referring to the sectional view of segment 28 as shown in FIG. 7, the preferred embodiment is a substantially rectangular shape. In other preferred embodiments, voids 58 may be added selectively around the periphery of the aperture 20 to locally soften corners of the aperture for added accommodation of patients with localized body contortions for improved comfort and positioning. In this embodiment, these voids 58 traverse the thickness of core 20 and their openings may be of a variety of geometric shapes.

Similarly, as shown in FIG. 7, outer edges 60 may be rounded to a profile similar to 62, to provide ease in manufacture and to reduce impediments to patient transfer to and from the seating.

Referring to FIGS. 3 and 4, the preferred embodiment of the invention includes a moveable and removable lumbosacral support 22. The preferred length 64 of support 22 is no more than 90% of the width dimension 48 of core 20. The preferred height 66 of support 22 is at least 4 inches, and the front surface 68 of support 22 preferably is arcuate in shape in the vertical direction.

Figure 7A:
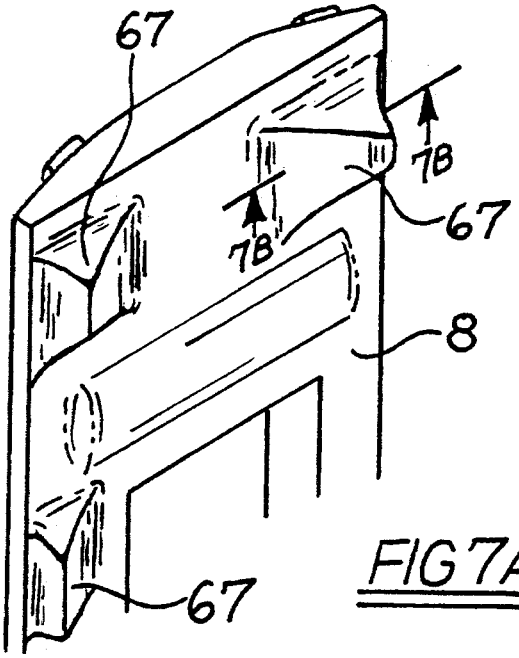
Figure 7B:
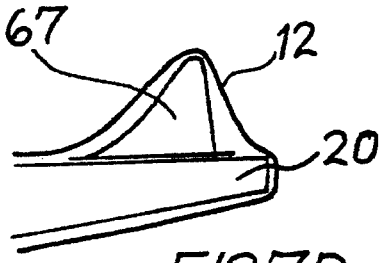

Support 22 preferably is not permanently attached to core 20, but is held in position by friction to core 20 from the tension of the cover 12 on the fit of cover 12 to core 20 and support 22. This allows support 22 to be positioned relative to core 20 such that the cushion 4 can best accommodate the geometry of various patient body types. In another embodiment as illustrated in FIGS. 7*a* and 7*b*, cover 12 is made from a stretch material similar to the brand Darlexx supplied by Darlington Industries, New York, N.Y. In this embodiment, the elasticity of the cover 12 allows the cover to stretch to enable the insertion of various positioning pieces 67, i.e., wedges and other shapes, between the cover and the front side of core 20. The tension created by the cover 12 and the core 20 enables these positioning pieces 67 to maintain their orientation relative to core 20 during patient use.

Referring to FIGS. 3, and 4, the preferred embodiment of the invention uses a flat support base 24 essentially of a rigid polymeric material such as styrene and limited flexibility to curve as shown in the top view in the top view to conform to the rear convex curved shape of core 20.

Referring to FIG. 3A, in another embodiment of the invention, the rear surface 70 of support core 72 is essentially flat, while the rigid support base 74 is molded to provide both the rear curved convex surface 10 of the cushion 4 for chair fit and the physical support for the essentially flat but resilient foam core 72.

Figure 8:
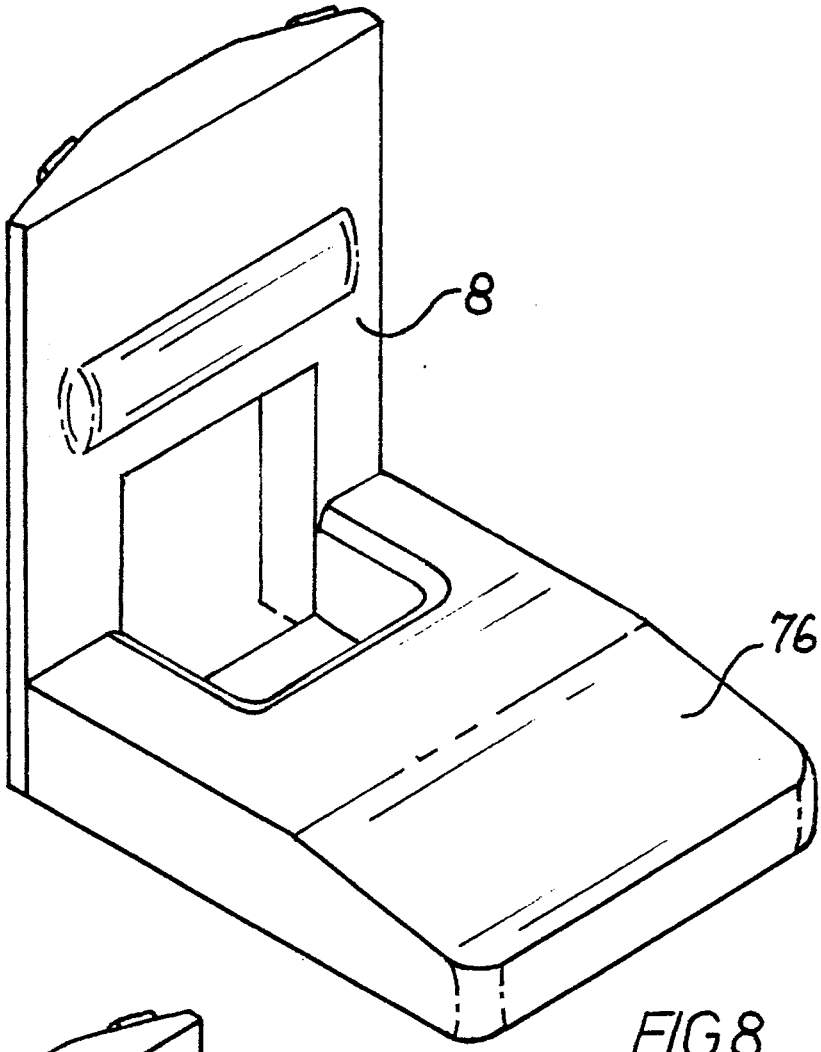
FIG 8 is a perspective view which illustrates another preferred embodiment of the invention combining the back cushion as described in this specification with the seat cushion described in my U.S. Pat. No. 4,951,334.

Referring to FIG. 8, another preferred embodiment of the invention comprises the combination of the pressure relief back cushion 4 as heretofore described with the seating cushion 76 as described in my U.S. Pat. No. 4,951,334. The combination cushion may be made in two discrete sections, in which case the rear side of back cushion 4 is positioned to be in contact with the seat back of the chair, the bottom side of the back cushion 4 is in contact with the seat bottom of the chair, and the seat cushion 76 is on the chair seat immediately in front of cushion 4. This assembly then forms a continuous right angle aperture that simultaneously eliminates pressure from the most critical body areas of the ischials, sacrum and coccyx while maintaining proper body posture and by position passively restraining slouching, tilt and sideways movement. Alternatively, the combination seat-back cushion can be made as a unitary structure with the physical shapes and dimensions of the seat and back components made as described here and in my U.S. Pat. No. 4,951,334, and covered as described here and as known in the art especially from the Isch-Dish brand seat cushion as sold by Embracing Concepts, Inc. of Rochester, N.Y.

What is claimed is:

1. A substantially inverted U-shaped integral pressure relief back cushion for use on a seat to support the posterior superior iliac spine and to eliminate pressure from the coccyx and sacrum regions of the human body at the bottom of the spinal column, for persons with skin prone to pressure induced ulceration, the cushion comprising a core of resilient material with a vertical center section, two vertical side sections, and at least front, rear, top and bottom surfaces, a substantially rectangular aperture extending below the center section bounded on three sides by said center section and said side sections, with the remaining side being open through the depth of the core from the front surface to the back surface wherein said open side of the aperture is at the bottom surface of the core to form two leg extensions, the center section having a thickness of at least 1.5 inches, the side sections having a thickness no greater than the center section, with no portion of the front surfaces of the leg extensions extending forward of the front surface of the center section, thereby to prevent rearward pelvic tilt, wherein the thickness of the center and side sections and the width and height of the aperture are dimensioned to both suspend and eliminate touching of the sacrum and coccyx regions with any portion of the core, and the leg extensions positioned to provide direct body support to the lateral sides of the posterior superior iliac spine.

2. A back cushion according to claim 1 wherein the core consists essentially of foam material.

3. A back cushion according to claim 2 wherein the foam material has a density of at least one pound per cubic inch and an Indention Load Deflection stiffness of at least about 25 pounds but no more than about 125 pounds.

4. A back cushion according to claim 2 and further comprising a rigid flat support member having overall vertical and horizontal dimensions approximately the same as those of the rear surface of the core to stabilize the core when in use.

5. A back cushion according to claim 1 wherein the center section is defined by the area of the core above the aperture and has a resiliency softer than the two side sections to reduce the pressure on the spinal column.

6. A back cushion according to claim 5 wherein the center and side sections of the core have a density of at least one pound per cubic inch and an indentation Load Deflection stiffness of at least about 25 pounds but no more than about 125 pounds.

7. A back cushion according to claim 1 wherein the aperture has a overall dimension of from about three inches to about ten inches in width and from about four inches to about ten inches in height, the dimensions being determined by upper body size of the user such that the sacrum and coccyx are free of contact pressure from the core but the posterior superior iliac spine of the user remains in contact with the leg extensions of the core.

8. A back cushion according to claim 1 wherein the rear surface of the core is a convex shape to fit the flexible backs of wheelchairs and other seating devices.

9. A cushion according to claim 1 in which the thickness of the side sections contiguous with the center section is the same as the thickness of the center section and the rear surfaces of the side sections taper forward to a lesser thickness at their outer edges.

10. A substantially inverted U-shaped integral pressure relief back cushion for seating to support the posterior superior iliac spine and to eliminate pressure from the coccyx and sacrum regions of the human body at the bottom of the spinal column, the cushion comprising a core of resilient material with at least front, rear, top and bottom sides, a substantially rectangular aperture bounded on three sides by said center section and said side sections with the remaining side being open, extending through the depth of the core from the front surface to the back surface with the open side of the aperture at the bottom surface of the core to form two leg extensions, the width and height of the aperture being dimensioned to eliminate pressure contact of the sacrum and coccyx regions with the core, and the leg extensions positioned to provide body support to the lateral sides of the posterior superior iliac spine, and further comprising a fabric cover for the entire core, a flap in the cover to access the core and a movable and removable lumbar support of resilient material positioned inside the cover on said front side of the core and above the aperture.

11. A back cushion according to claim 10 and further comprising elastic straps attached to the cover to hold the cushion in position on chairs when in use.

12. A back cushion according to claim 10 wherein the cover is made of an elastic material to enable the insertion of positioning pieces for patients requiring special positioning.

13. A back cushion according to claim 1 and including a substantially U-shaped rectilinear integral pressure relief seat cushion assembly having a seat core with at least top, bottom and rear sides, a substantially rectangular aperture extending through the depth of the seat core from the top side of the seat core to the bottom side of the seat core with the open end of the seat core aperture at the rear side of the seat core, the back core aperture and the seat core aperture being contiguous at the bottom and rear sides, respectively, of the back core and the seat core.

14. A seating cushion according to claim 13 wherein the back core and the seat core each are enclosed by a fabric cover and the cores are positioned in use on a chair with seat and back portions, the back portion in front of the chair back portion and touching the chair seat portion and the seat core on the chair seat portion immediately in front of the back core.

15. A seating cushion according to claim 13 wherein the back core and the seat core are both enclosed in a single fabric cover.

16. A seating cushion according to claim 13 wherein the back and seat cores comprise a foam material.

* * * * *